US008604985B1

(12) United States Patent
Wolf et al.

(10) Patent No.: US 8,604,985 B1
(45) Date of Patent: Dec. 10, 2013

(54) DUAL POLARIZATION ANTENNA WITH HIGH PORT ISOLATION

(75) Inventors: Jeremiah D. Wolf, Marion, IA (US); Mark M. Mulbrook, Marion, IA (US); James B. West, Cedar Rapids, IA (US); Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 275 days.

(21) Appl. No.: 13/230,912

(22) Filed: Sep. 13, 2011

(51) Int. Cl.
*H01Q 1/28* (2006.01)

(52) U.S. Cl.
USPC ..... 343/705; 343/727; 343/730

(58) Field of Classification Search
USPC ..... 343/705, 725, 727, 729, 730, 797, 850
See application file for complete search history.

(56) References Cited

U.S. PATENT DOCUMENTS

| | | | | |
|---|---|---|---|---|
| 2,673,254 | A * | 3/1954 | Eland | 330/53 |
| 2,838,755 | A * | 6/1958 | Albright et al. | 343/876 |
| 4,451,830 | A | 5/1984 | Lucas et al. | |
| 6,064,348 | A | 5/2000 | Cosenza et al. | |
| 6,608,602 | B2 | 8/2003 | Waltho et al. | |
| 6,653,982 | B2 * | 11/2003 | Lindenmeier et al. | 343/741 |
| 7,463,673 | B2 * | 12/2008 | Fujii et al. | 375/211 |
| 7,595,760 | B2 | 9/2009 | Lee et al. | |
| 2007/0046542 | A1 | 3/2007 | Andrenko et al. | |
| 2010/0019981 | A1 | 1/2010 | Ergene et al. | |

* cited by examiner

*Primary Examiner* — Hoanganh Le
(74) *Attorney, Agent, or Firm* — Donna P. Suchy; Daniel M. Barbieri

(57) ABSTRACT

The present invention is directed to an antenna system which may serve as a common antenna for multiple avionics systems implemented on-board an aircraft. The antenna system provides horizontal and vertical polarization functionality, while providing high isolation between a first input port of a coupler of the antenna system (the first input port being connected to a first avionics system) and a second input port of the coupler (the second input port being connected to a second avionics system).

20 Claims, 5 Drawing Sheets

DUAL POLARIZATION ANTENNA WITH HIGH PORT ISOLATION

FIELD OF THE INVENTION

The present invention relates to the field of antenna technology and particularly to a dual polarization antenna with high port isolation.

BACKGROUND OF THE INVENTION

Currently available avionics antenna systems may not provide a desirable level of Size, Weight, Power and Cost (SWAP-C) performance.

Thus, it would be desirable to provide an avionics antenna system which obviates the above-referenced problems associated with currently available avionics antenna systems.

SUMMARY OF THE INVENTION

Accordingly, an embodiment of the present invention is directed to an antenna system, including: a horizontal polarization antenna, the horizontal polarization antenna being configured for radiating electromagnetic energy in a horizontal polarization pattern; a twinlead transmission line, the twinlead transmission line being connected to the horizontal polarization antenna, the twinlead transmission line being configured for radiating electromagnetic energy in a vertical polarization pattern; a feed structure, the feed structure being connected to the twinlead transmission line, the feed structure including a plurality of transmission feed lines; and a coupler, the coupler being connected to the feed structure, the coupler including a first input port and a second input port, the first input port configured for being connected to a first electronics system, the second input port configured for being connected to a second electronics system, wherein the coupler isolates the first input port from the second input port.

A further embodiment of the present invention is directed to a method of operation of an antenna system, the method including: receiving a first input from a first avionics system via a first port of a coupler of the antenna system; providing a first output via the coupler to a feed structure of the antenna system, the first output being based upon the first input, the first output causing feed lines of the feed structure to be excited in-phase; in response to the in-phase excitation of the feed lines of the feed structure, producing common mode currents on a twinlead transmission line of the antenna system; in response to the common mode currents being produced on the twinlead transmission line, radiating electromagnetic energy in a vertical polarization pattern via the twinlead transmission line; receiving a second input from a second avionics system via a second port of the coupler, the second port being isolated from the first port; providing a second output via the coupler to the feed structure, the second output being based upon the second input, the second output causing the feed lines of the feed structure to be excited out-of-phase; in response to the out-of-phase excitation of the feed lines of the feed structure, producing differential mode currents on the twinlead transmission line; transmitting the differential mode currents via the twinlead transmission line to a horizontal polarization antenna of the antenna system; in response to receiving the differential mode currents provided by the twinlead, radiating electromagnetic energy in a horizontal polarization pattern via the horizontal polarization antenna of the antenna system; and presenting a common mode open circuit via the horizontal polarization antenna to the twinlead for preventing common mode currents from traveling into radiating elements of the horizontal polarization antenna.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Aircraft, spacecraft and/or artificial satellites implement multiple on-board electronics systems (ex.—avionics systems) which may include: communications systems; navigation systems; monitoring systems; flight control systems; collision-avoidance systems; weather systems; management systems; mission systems; tactical systems; military communications systems; radar systems; sonar systems; electro-optic systems; electronic support measures systems; defensive aids systems; aircraft networks systems; disaster relief systems; and/or air ambulance systems. Currently, the multiple avionics systems implemented on-board an aircraft each require their own corresponding antenna installations (ex.—antenna assemblies; antenna systems). Further, sufficient physical distance must be maintained between these antenna assemblies, in order to provide sufficient isolation between the multiple avionics systems.

The antenna system (ex.—antenna assembly) embodiments of the present disclosure may reduce the number of antennas which need to be implemented with avionics systems on-board an aircraft by providing a single antenna assembly (ex.—antenna structure) which may serve as a common antenna for multiple avionics systems. Further, in reducing the number of antenna installations which may be needed, the antenna system embodiments of the present disclosure may provide a smaller size, lighter weight alternative to the currently-implemented antenna systems. As a result, the antenna system(s) of the present disclosure may promote lower costs for the airline; reduced maintenance time for the antenna system; and less weight and drag on the aircraft.

Figure 1:
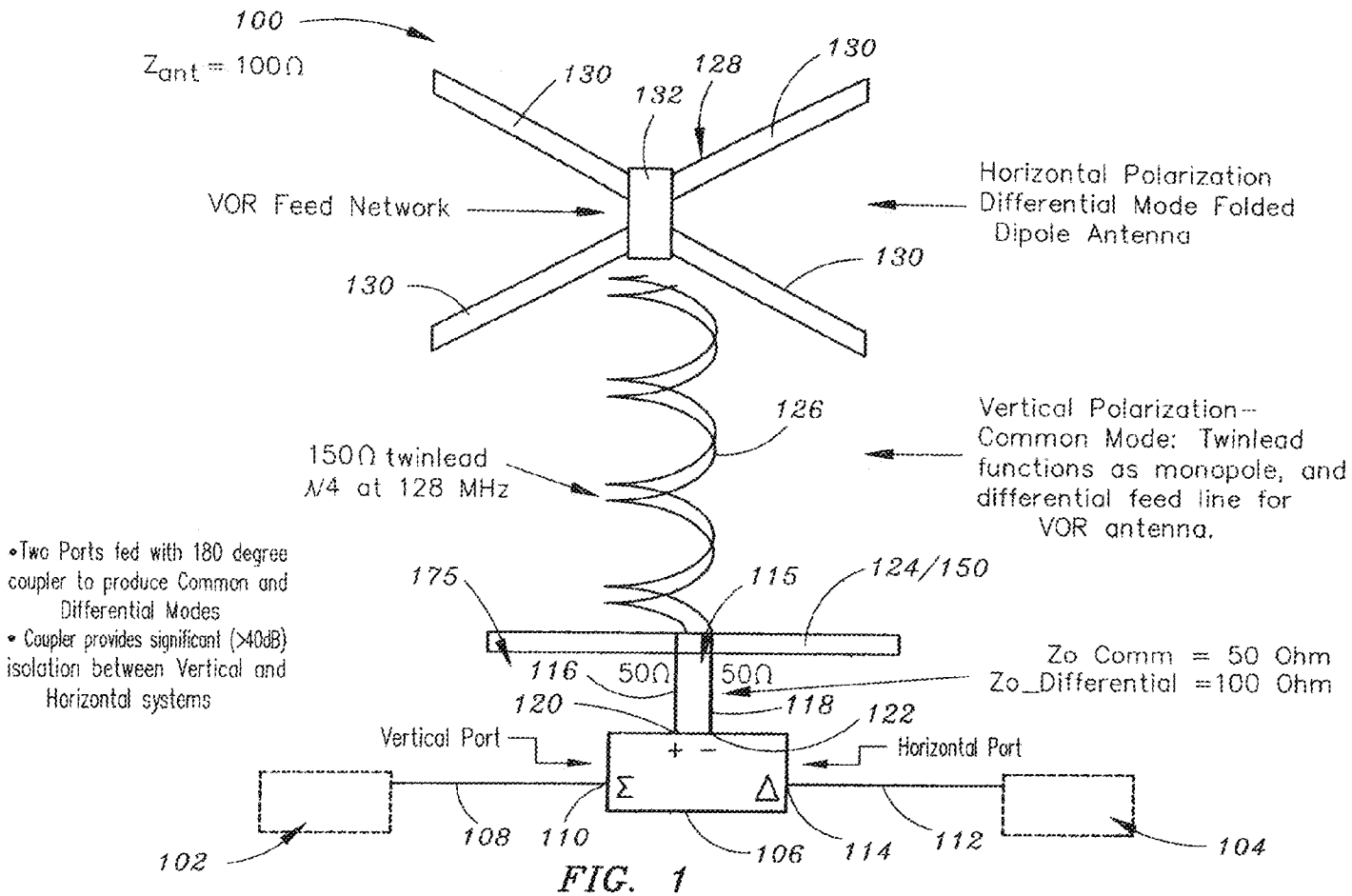
FIG. 1 is a block diagram schematic of an antenna system, the antenna system being connected to a plurality of avionics systems in accordance with an exemplary embodiment of the present invention.

Referring to FIG. 1, an antenna system in accordance with an exemplary embodiment of the present disclosure is shown. In exemplary embodiments of the present disclosure, the antenna system (ex.—antenna assembly; integrated antenna; antenna; Integrated Communication Navigation and Surveillance (ICNS) antenna system) 100 may be connected to a plurality of electronics systems (ex.—avionics systems). For instance, the antenna system 100 may be connected to a first avionics system (ex.—a Very High Frequency (VHF) avionics system) 102 and a second avionics system (ex.—a VHF omni-directional range (VOR) avionics system) 104. In further embodiments of the present disclosure, the antenna system 100 may include a coupler (ex.—a hybrid coupler) 106, the coupler 106 being connected to both the first avionics system 102 and the second avionics system 104. In still further embodiments of the present disclosure, the coupler 106 may be a one-hundred-eighty degree coupler 106.

In an embodiment of the present disclosure, a first coupler feed line 108 may connect the first avionics system 102 to a first port 110 of the coupler 106. In further embodiments of the present disclosure, a second coupler feed line 112 may connect the second avionics system 104 to a second port 114 of the coupler 106. In exemplary embodiments of the present disclosure, the coupler 106 may be connected to a feed structure 115, said feed structure 115 including a plurality of transmission lines (ex.—feed lines; transmission feed lines). For instance, the feed structure 115 may include a first transmission feed line (ex.—an unbalanced transmission feed line) 116 and a second transmission feed line 118. In further embodiments of the present disclosure, the first transmission feed line 116 is connected to a third port 120 of the coupler 106. In still further embodiments of the present disclosure, the second transmission feed line 118 is connected to a fourth port 122 of the coupler 106.

In exemplary embodiments of the present disclosure, the transmission feed lines (116, 118) may be routed into and/or through (ex.—may be connected to) a ground plane structure 124. In further embodiments of the present disclosure, the antenna system 100 may further include a twinlead transmission line (ex.—twinline; twinlead) 126. In an embodiment of the present disclosure, the twinlead transmission line 126 may be connected to (ex.—driven against) the ground plane structure 124. In still further embodiments of the present disclosure, the twinlead transmission line 126 may be connected to the transmission feed lines (116, 118) of the feed structure 115.

In embodiments of the present disclosure, the antenna system 100 may further include a first antenna sub-assembly 128, the first antenna sub-assembly 128 being connected to the twinlead 126. In further embodiments of the present disclosure, the first antenna sub-assembly 128 may include a plurality of elements (ex.—dipoles) 130. In still further embodiments of the present disclosure, the first antenna sub-assembly 128 may include a feed network 132, the feed network 132 being connected to the plurality of elements 130. In exemplary embodiments of the present disclosure, the plurality of elements 130 may be connected to the twinlead 126 via the feed network 132. In further embodiments of the present disclosure, the twinlead 126 may function as a second antenna sub-assembly of the antenna system 100, which will be described in further detail below.

In further embodiments of the present disclosure, the antenna system 100 may be configured for operating in a reception mode and/or a transmission mode. For example, the antenna system 100 may be configured for radiating and/or receiving electromagnetic energy via the first antenna sub-assembly 128 and/or the second antenna sub-assembly (ex.—the twinlead) 126. Further, the avionics systems (102, 104) may be configured for receiving signals from and/or transmitting signals via the antenna system 100. For the purpose of simplicity, the exemplary discussion provided below will focus on how transmission of signals is performed via the antenna system (ex.—will focus on how electromagnetic energy is transmitted via the antenna sub-assemblies (126, 128)).

In exemplary embodiments of the present disclosure, the coupler 106 may be configured for receiving a first input, the first input being provided by the first avionics system (ex.—the VHF avionics system) 102 via the first coupler feed line 108, the first input being received via the first port 110 of the coupler 106. In further embodiments of the present disclosure, the coupler 106 is configured for providing a first output to the feed structure 115, the first output being based upon (ex.—derived from) the first input. In an embodiment of the present disclosure, the first output may cause the feed lines (116, 118) of the feed structure 115 to be excited in-phase, thereby causing common mode current(s) to be produced on the twinlead 126. The common mode current(s) produced on the twinlead 126 may excite a monopole response in the twinlead 126 (ex.—may cause the twinlead 126 to function as a monopole), thereby causing electromagnetic energy to be radiated via the twinlead (ex.—second antenna sub-assembly) 126 in a vertical polarization pattern.

In an embodiment of the present disclosure, the coupler 106 may be configured for receiving a second input, the second input being provided by the second avionics system (ex.—the VOR avionics system) 104 via the second coupler feed line 112, the second input being received via the second port 114 of the coupler 106. In further embodiments of the present disclosure, the coupler 106 is configured for providing a second output to the feed structure 115, the second output being based upon (ex.—derived from) the second input. In an embodiment of the present disclosure, the second output may cause the feed lines (116, 118) of the feed structure to be excited out-of-phase, thereby causing differential mode current(s) to be produced on the twinlead 126. In further embodiments of the present disclosure, the differential mode current(s) produced on the twinlead 126 may be transmitted, via the twinlead 126 (ex.—up the twinlead), to the first antenna sub-assembly 128. In still further embodiments of the present disclosure, the differential mode current(s) may excite the first antenna sub-assembly 128, thereby causing electromagnetic energy to be radiated via the elements 130 of the first antenna sub-assembly 128 in a horizontal polarization pattern.

As described above, the coupler 106 is configured for selectively providing outputs to the feed structure 115 for causing either differential mode currents or common mode currents to be produced on the twinlead 126. When the coupler 106 provides outputs which cause differential mode currents to be produced on the twinlead 126, the coupler 106 is selectively causing the antenna assembly 100 to operate in differential mode. When the coupler 106 provides outputs which cause common mode currents to be produced on the twinlead 126, the coupler 106 is selectively causing the antenna assembly 100 to operate in common mode.

In an exemplary embodiment of the present disclosure, when the antenna assembly 100 is operating in common mode, the first avionics system 102, the first coupler feed line 108, the first port 110 of the coupler 106, the third port 120 of the coupler, the feed structure 115, and the vertical polarization antenna 126 may be connected (ex.—communicatively coupled) for allowing electromagnetic energy to be radiated via the vertical polarization antenna (ex.—the twinlead) 126. In further embodiments of the present disclosure, when the antenna assembly 100 is operating in differential mode, the second avionics system 104, the second coupler feed line 112, the second port 114 of the coupler 106, the fourth port 122 of the coupler 106, the feed structure 115, the twinlead transmission line 126 and the horizontal polarization antenna 128 may be connected (ex.—communicatively coupled) for allowing electromagnetic energy to be radiated via the horizontal polarization antenna 128. In still further embodiments of the present disclosure, the coupler 106 is configured for providing isolation between the first port 110 (ex.—the vertical port) of the coupler 106 and the second port 114 (ex.—the horizontal port) of the coupler 106, and is further configured for providing isolation between the horizontal polarization antenna 128 and the vertical polarization antenna 126. For example, the coupler 106 may be configured for providing greater than forty decibels (dB) of isolation between the horizontal polarization antenna 128 and the vertical polarization antenna 126. This ability of the coupler 106 to provide the above-described isolation between the ports (110, 114) and the antenna sub-assemblies (126, 128) allows for the avionics systems (102, 104) to concurrently (ex.—simultaneously) utilize the same antenna assembly (ex.—antenna assembly 100) for transmitting and/or receiving communications (ex.—for radiating electromagnetic energy). For example, when the avionics systems (102, 104) are similar in frequency and require the ability to operate concurrently (ex.—such as the VHF and VOR systems described herein), such isolation, as provided by the coupler 106 of the antenna assembly 100 disclosed herein is critical. In still further embodiments of the present disclosure, the antenna assembly 100 provides the above-described isolation between the horizontal polarization antenna 128 and the vertical polarization antenna 126 without having to utilize (ex.—implement) a ferrite bead.

As described above, the transmission feed lines (116, 118) are configured for feeding the antenna sub-assemblies (126, 128). The transmission feed lines (116, 118) of the feed structure 115 may be specialized cables designed to carry alternating current of radio frequency. In exemplary embodiments of the present disclosure, the transmission feed lines (116, 118) may each have an impedance (Z) of fifty ohms. In further embodiments, when the transmission feed lines (116, 118) are excited in-phase (common mode), the characteristic impedance ($Z_o$) of the transmission feed lines (116, 118) may be fifty ohms. In still further embodiments, when the transmission feed lines (116, 118) are excited out-of-phase (differential mode), the characteristic impedance of the transmission feed lines (116, 118) may be one-hundred ohms.

In exemplary embodiments of the present disclosure, the twinlead (ex.—twinline monopole antenna, vertical polarization antenna, common mode antenna, VHF antenna) 126 may have at least double the impedance of the transmission feed lines (116, 118). For instance, the twinlead 126 may have an impedance of one-hundred fifty ohms and may be a quarter wave monopole antenna ($\lambda/4$) at 128 Megahertz (MHz). In further embodiments of the present disclosure, the twinlead 126 may oriented to extend (ex.—run) vertically from the ground plane structure 124 to the first antenna sub-assembly (ex.—horizontal polarization antenna, horizontally-polarized antenna, horizontal monopole, horizontal antenna, differential mode folded dipole antenna, crossed folded dipole antenna, VOR antenna) 128. In still further embodiments of the present disclosure, as described above, the twinlead 126 may be configured to function as a differential feed line for the horizontal polarization antenna 128.

Figure 2B:
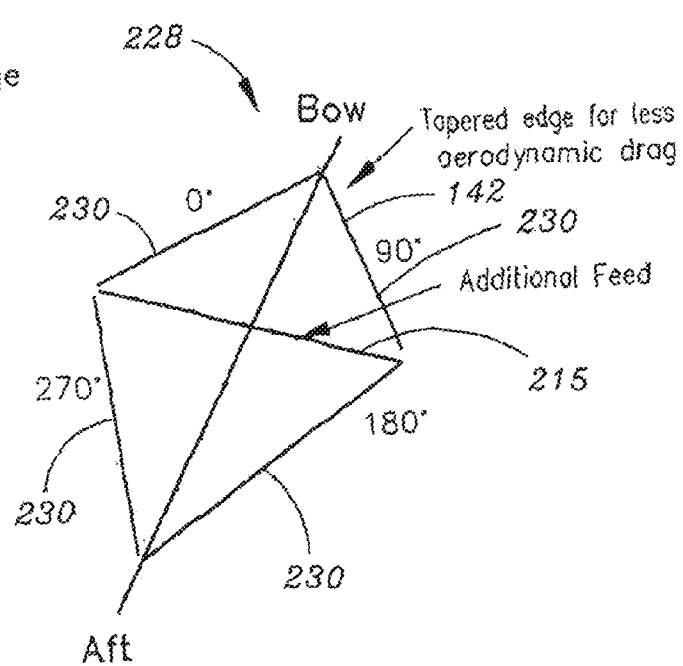
FIG. 2B is a diagram of an alternative exemplary embodiment of a horizontal polarization antenna configured for implementation as part of an antenna system of the present invention.
Figure 2A:
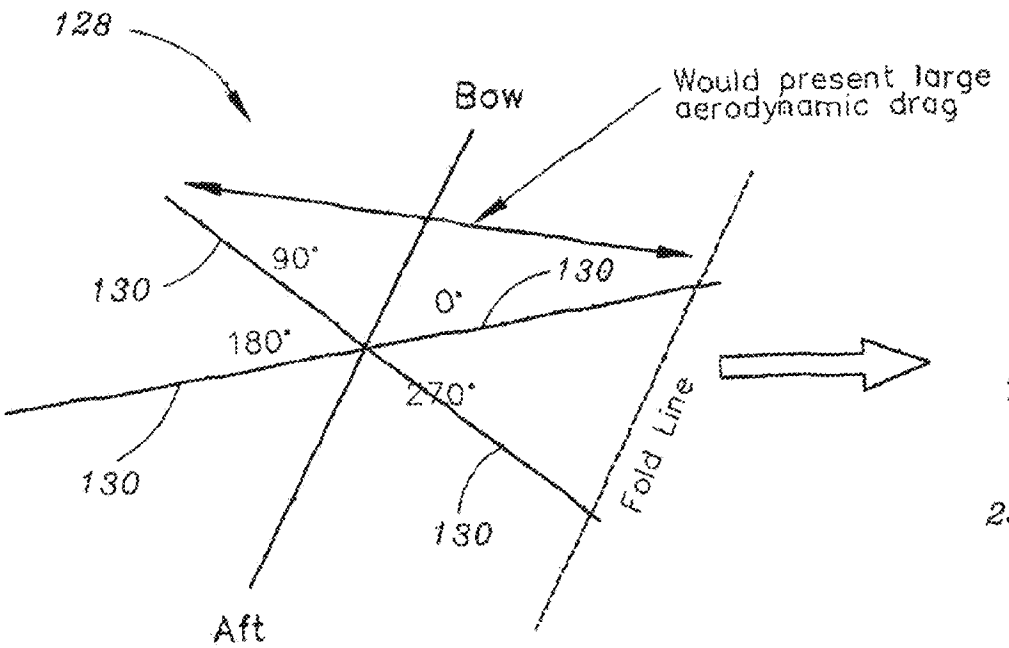
FIG. 2A is a diagram of a horizontal polarization antenna of the antenna system shown in FIG. 1 in accordance with an exemplary embodiment of the present invention.
Figure 3B:
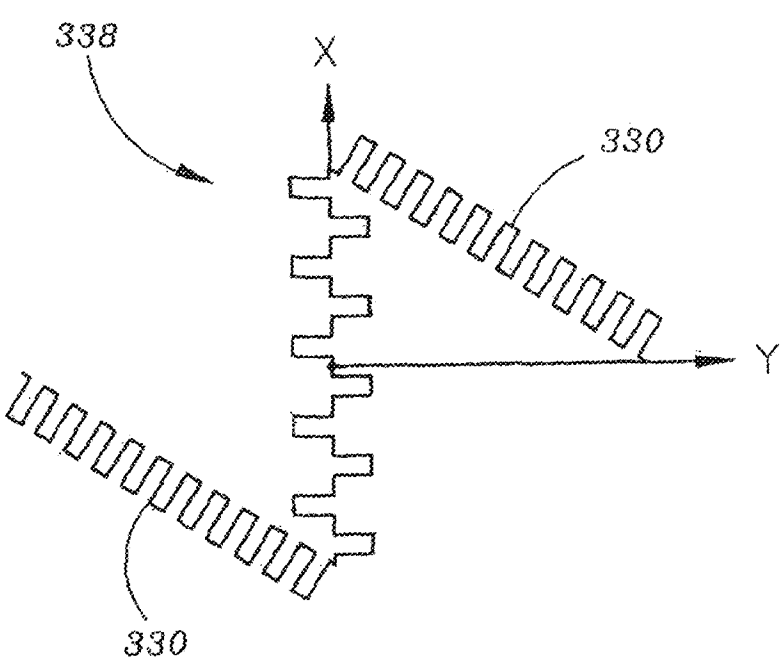
FIG. 3B is a top view of a bottom portion (ex.—bottom radiating element(s) of the meandered folded dipole antenna of FIG. 3A.
Figure 3A:
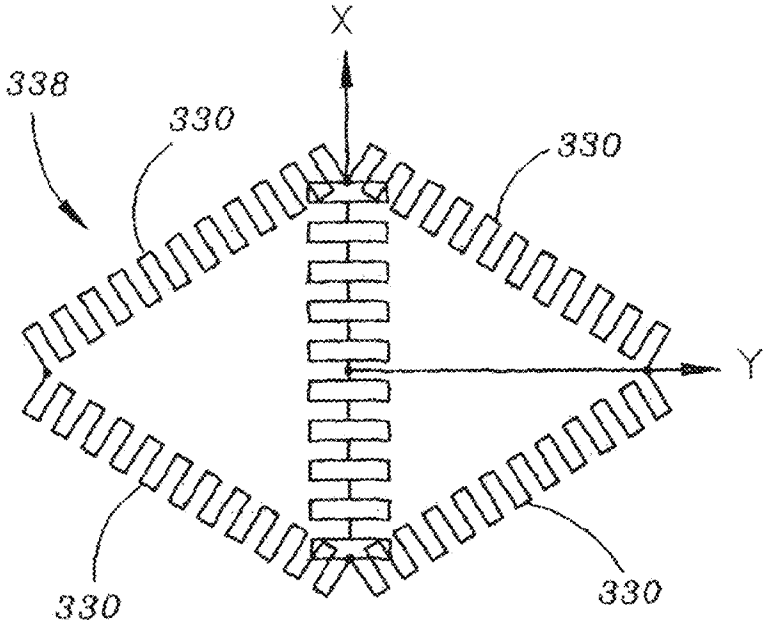
FIG. 3A is a top view of a horizontal polarization antenna configured for implementation as part of an antenna system of the present invention, the horizontal polarization antenna of FIG. 3A being a meandered folded dipole antenna in accordance with a further exemplary embodiment of the present invention.
Figure 3D:
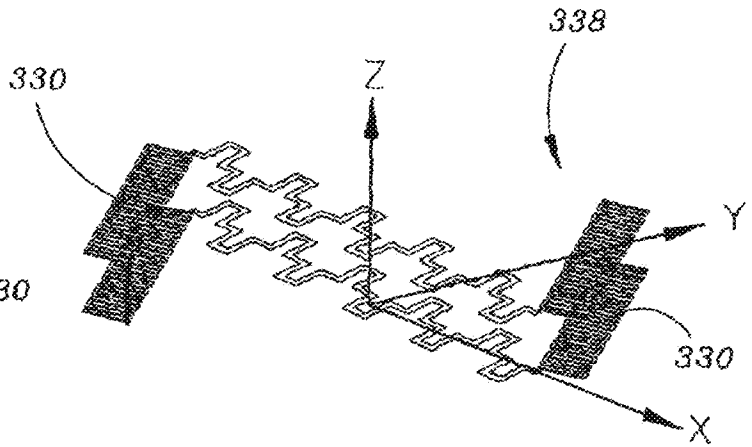
FIG. 3D is a perspective view of the bottom portion of the meandered folded dipole antenna of FIG. 3A.
Figure 3C:
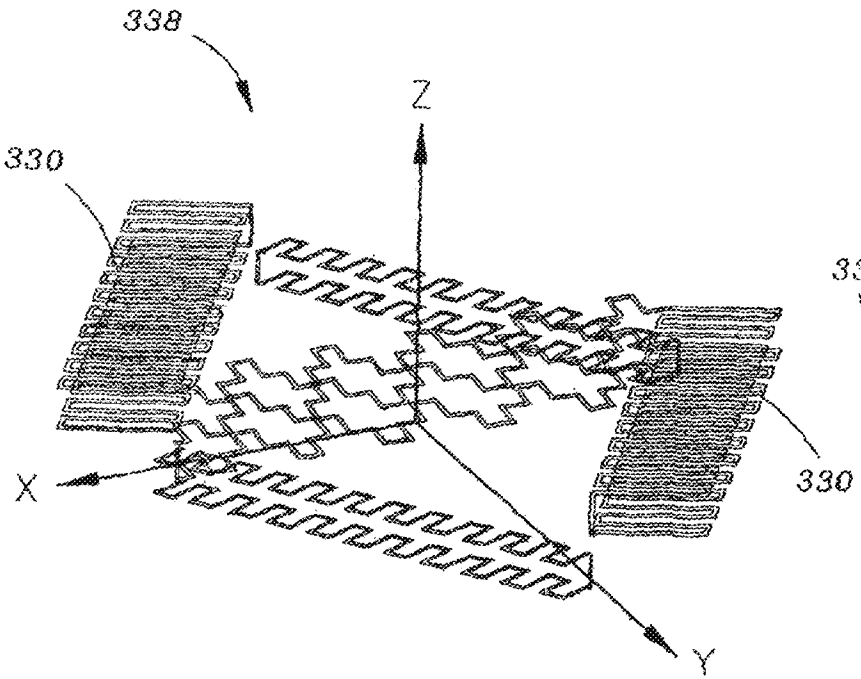
FIG. 3C is a perspective view of the meandered folded dipole antenna of FIG. 3A.

As described above, the horizontal polarization antenna 128 may include a plurality of elements (ex.—dipoles) 130. In an embodiment of the present disclosure, the horizontal polarization antenna 128 may include two dipoles 130 which are configured in a crossed orientation (ex.—are crossed horizontal radiating elements, crossed dipoles), as shown in FIGS. 1 and 2A. Further, the two dipoles 130 may be configured to be ninety degrees out-of-phase with respect to each other. As mentioned above, the elements 130 of the horizontal polarization antenna 128 may be configured for radiating electromagnetic energy in a horizontal polarization pattern. In further embodiments of the present disclosure, the horizontal polarization pattern (ex.—the horizontal polarization) provided by the horizontal polarization antenna 128 may be omni-directional (ex.—null free). In still further embodiments of the present disclosure, when the elements 130 are configured as crossed horizontal radiating elements (as shown in FIGS. 1 and 2A), the elements 130 may exhibit superior omni performance and may provide a good azimuthal phi polarized radiation pattern.

In an embodiment of the present disclosure, as mentioned above, the horizontal polarization antenna 128 may further include a feed network (ex.—a VOR feed network) 132, the feed network 132 being connected to the plurality of elements (ex.—the crossed elements) 130, the plurality of elements 130 being connected to the twinlead 126 via the feed network 132. In further embodiments of the present disclosure, the horizontal polarization antenna 128 may provide a common mode open circuit to the twinline monopole antenna 126, thereby preventing common mode currents from traveling into the horizontal antenna 128. In further embodiments of the present disclosure, embedded impedance matching and/or filtering structures may be configured (ex.—may be implemented) at a junction between the horizontal polarization antenna 128 and the vertical polarization antenna 126 to provide design flexibility. In still further embodiments of the present disclosure, the horizontal polarization antenna 128 may have an impedance of 100 ohms.

In exemplary embodiments of the present disclosure, the antenna system 100 may be connected to (ex.—implemented on-board) a pressure vessel 150, such as an aircraft, spacecraft, or the like. For example, the twinlead 126 may be connected to (ex.—mounted upon) the ground plane structure 124, such that the ground plane structure 124 may be an exterior surface of an airframe of an aircraft 150. In further embodiments of the present disclosure, the avionics systems (102, 104) may be remotely located from the vertical polarization antenna 126 and the horizontal polarization antenna 128. In an exemplary embodiment of the present disclosure, the avionics systems (102, 104) and the coupler 106 may be located within an interior area 175 of the pressure vessel 150. For instance, the avionics systems (102, 104) may be located within an avionics bay located within a fuselage of the aircraft 150.

In further exemplary embodiments of the present disclosure, the horizontal polarization antenna 128 may be configured to implement further space-saving features within its design, such as meandering and lumped loading. For example, several configurations of crossed horizontal radiating elements 130 are possible, such as a crossed lumped loaded dipole configuration, a lumped loaded folded dipole configuration, a meander line configuration, a lumped loaded meander line configuration, and the like. In an alternative embodiment of the present disclosure, a horizontal polarization antenna 228, may have its dipoles 230 arranged as shown in FIG. 2B, so as to present a tapered edge 142 for promoting improved aerodynamic performance (ex.—less drag). In the configuration shown in FIG. 2B, the horizontal polarization antenna 228 may include multiple feed structures (ex.—an additional feed structure) 215 for feeding the antenna 228. The dipoles 230 of horizontal polarization antenna 228 may be configured for maintaining their individual excitation phases for promoting improved drag and reduced size. In a further alternative embodiment of the present disclosure, a horizontal polarization antenna (ex.—meandered folded dipole antenna) 328, as shown in FIGS. 3A through 3D, may implement a design in which its dipoles 330 are configured in a meandered, folded design (ex.—are meandered folded dipoles 330). Exemplary dimensions for the meandered folded dipole antenna 328 may be: twelve inches in width by eighteen inches in length by 2.5 inches in height, which may equal 0.110 wavelength (λ) by 0.165λ by 0.022λ. In further embodiments of the present disclosure, the wavelength for the meandered folded dipole antenna 328 may be 109.3 inches at 108 Megahertz.

Figure 4:
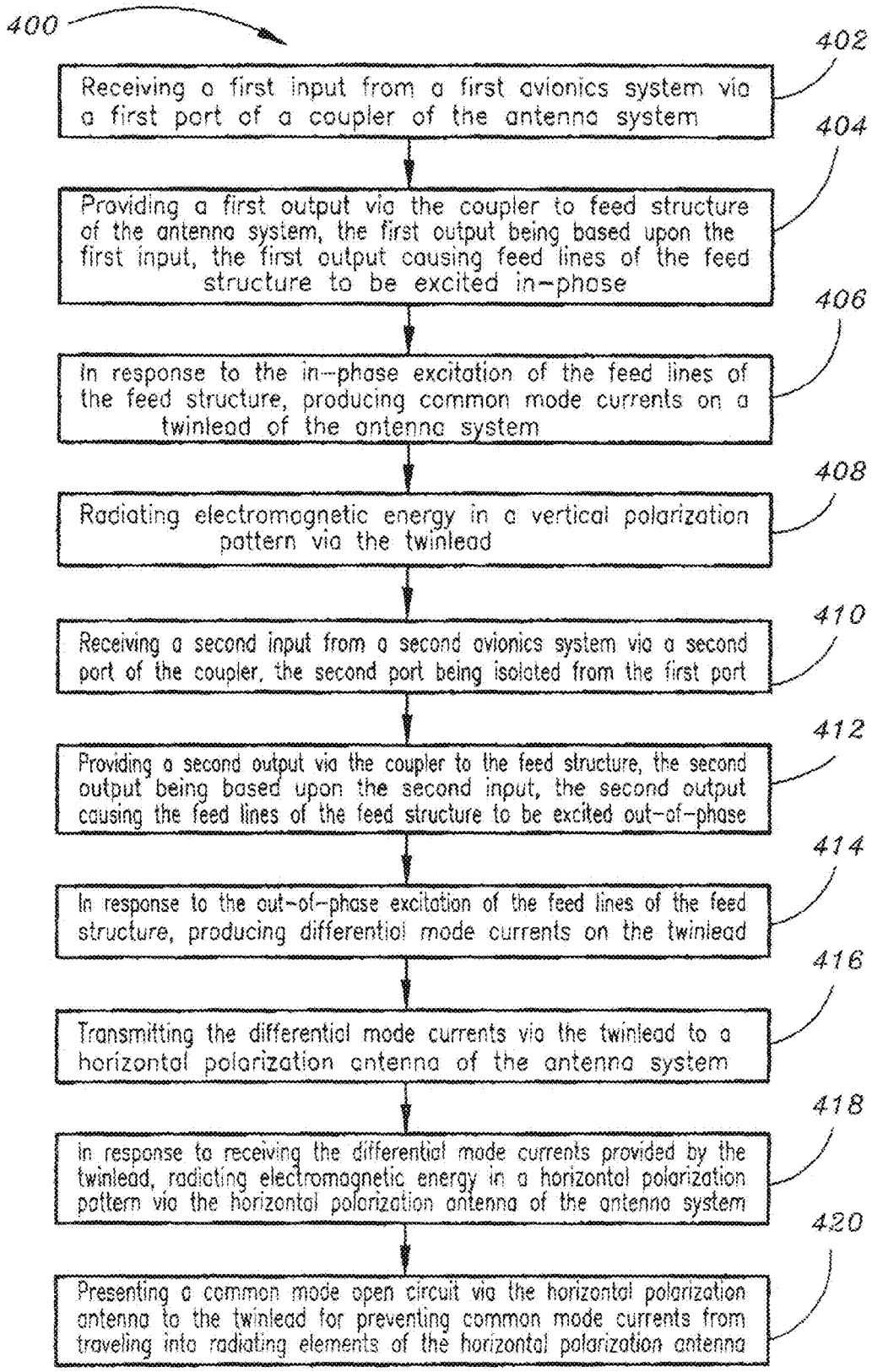
FIG. 4 depicts a flowchart illustrating a method of operation of the antenna system, such as the antenna system shown in FIG. 1, in accordance with an exemplary embodiment of the present invention.

Referring to FIG. 4, a flowchart illustrating a method of operation of an antenna system (such as the antenna system 100 described herein) in accordance with an exemplary embodiment of the present disclosure is shown. The method 400 may include the step of receiving a first input from a first avionics system via a first port of a coupler of the antenna system 402. The method 400 may further include the step of providing a first output via the coupler to a feed structure of the antenna system, the first output being based upon the first input, the first output causing feed lines of the feed structure to be excited in-phase 404. The method 400 may further include, in response to the in-phase excitation of the feed lines of the feed structure, producing common mode currents on a twinlead transmission line of the antenna system 406. The method 400 may further include radiating electromagnetic energy in a vertical polarization pattern via the twinlead 408.

In further embodiments of the present disclosure, the method 400 may further include the step of receiving a second input from a second avionics system via a second port of the coupler, the second port being isolated from the first port 410. The method 400 may further include the step of providing a second output via the coupler to the feed structure, the second output being based upon the second input, the second output causing the feed lines of the feed structure to be excited out-of-phase 412. The method 400 may further include, in response to the out-of-phase excitation of the feed lines of the feed structure, producing differential mode currents on the twinlead transmission line 414. The method 400 may further include transmitting the differential mode currents via the twinlead to a horizontal polarization antenna of the antenna system 416. The method 400 may further include, in response to receiving the differential mode currents provided by the twinlead, radiating electromagnetic energy in a horizontal polarization pattern via the horizontal polarization antenna of the antenna system 418. The method 400 may further include the step of presenting a common mode open circuit via the horizontal polarization antenna to the twinlead for preventing common mode currents from traveling into radiating elements of the horizontal polarization antenna 420.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna system, comprising:

a horizontal polarization antenna, the horizontal polarization antenna being configured for radiating electromagnetic energy in a horizontal polarization pattern;

a twinlead transmission line, the twinlead transmission line being connected to the horizontal polarization antenna, the twinlead transmission line being configured for radiating electromagnetic energy in a vertical polarization pattern;

a feed structure, the feed structure being connected to the twinlead transmission line, the feed structure including a plurality of transmission feed lines; and a coupler, the coupler being connected to the feed structure, the coupler including a first input port and a second input port, the first input port configured for being connected to a first electronics system, the second input port configured for being connected to a second electronics system, wherein the coupler isolates the first input port from the second input port.

2. An antenna system as claimed in claim 1, wherein the first electronics system is a Very High Frequency (VHF) avionics system and the second electronics system is a VHF omni-directional range (VOR) avionics system.

3. An antenna system as claimed in claim 1, wherein the coupler is a hybrid one-hundred eighty degree coupler.

4. An antenna system as claimed in claim 1, wherein the coupler provides at least 40 decibels of isolation between the first input port and the second input port.

5. An antenna system as claimed in claim 1, wherein the horizontal polarization pattern is omni-directional.

6. An antenna system as claimed in claim 1, wherein the horizontal polarization antenna is a crossed folded dipole antenna.

7. An antenna system as claimed in claim 1, wherein the coupler receives a first input and a second input, the first input being received from the first electronics system via the first input port, the second input being received from the second electronics system via the second input port.

8. An antenna system as claimed in claim 7, wherein the coupler provides a first output to the feed structure, the first output being based upon the first input, the first output causing in-phase excitation of the feed lines of the feed structure, the in-phase excitation of the feed structure causing common mode currents to be produced on the twinlead transmission line, the common mode currents causing the radiation of electromagnetic energy in a vertical polarization pattern to occur via the twinlead transmission line.

9. An antenna system as claimed in claim 8, wherein the coupler provides a second output to the feed structure, the second output being based upon the second input, the second output causing out-of-phase excitation of the feed lines of the feed structure, the out-of-phase excitation of the feed structure causing differential mode currents to be produced on the twinlead transmission line, the differential mode currents being fed from the twinlead transmission line to the horizontal polarization antenna for causing the radiation of electromagnetic energy in a horizontal polarization pattern to occur via the horizontal polarization antenna.

10. An antenna system as claimed in claim 9, wherein the horizontal polarization antenna provides a common mode open circuit to the twinlead transmission line, thereby preventing common mode currents from traveling into the horizontal polarization antenna.

11. An antenna system as claimed in claim 1, wherein the twinlead transmission line is driven against a ground plane structure.

12. An antenna system as claimed in claim 11, wherein the ground plane structure is a surface of a pressure vessel.

13. An antenna system as claimed in claim 12, wherein the pressure vessel is one of: an aircraft and a spacecraft.

14. A method of operation of an antenna system, the method comprising:

receiving a first input from a first avionics system via a first port of a coupler of the antenna system;

providing a first output via the coupler to a feed structure of the antenna system, the first output being based upon the first input, the first output causing feed lines of the feed structure to be excited in-phase;

in response to the in-phase excitation of the feed lines of the feed structure, producing common mode currents on a twinlead transmission line of the antenna system; and in response to the common mode currents being produced on the twinlead transmission line, radiating electromagnetic energy in a vertical polarization pattern via the twinlead transmission line.

15. A method as claimed in claim 14, further comprising:

receiving a second input from a second avionics system via a second port of the coupler, the second port being isolated from the first port.

16. A method as claimed in claim 15, further comprising:

providing a second output via the coupler to the feed structure, the second output being based upon the second input, the second output causing the feed lines of the feed structure to be excited out-of-phase; and in response to the out-of-phase excitation of the feed lines of the feed structure, producing differential mode currents on the twinlead transmission line.

17. A method as claimed in claim 16, further comprising:

transmitting the differential mode currents via the twinlead transmission line to a horizontal polarization antenna of the antenna system.

18. A method as claimed in claim 17, further comprising:

in response to receiving the differential mode currents provided by the twinlead, radiating electromagnetic energy in a horizontal polarization pattern via the horizontal polarization antenna of the antenna system.

19. A method as claimed in claim 18, further comprising:

presenting a common mode open circuit via the horizontal polarization antenna to the twinlead for preventing common mode currents from traveling into radiating elements of the horizontal polarization antenna.

20. An antenna system, comprising:

a crossed folded dipole antenna, the folded dipole antenna being configured for radiating electromagnetic energy in a horizontal polarization pattern;

a twinlead transmission line, the twinlead transmission line being connected to the crossed folded dipole antenna, the twinlead transmission line being configured for radiating electromagnetic energy in a vertical polarization pattern;

a feed structure, the feed structure being connected to the twinlead transmission line, the feed structure including a plurality of transmission feed lines; and a one-hundred eighty degree coupler, the coupler being connected to the feed structure, the coupler including a first input port and a second input port, the first input port configured for being connected to a first electronics system, the second input port configured for being connected to a second electronics system, wherein the coupler isolates the first input port from the second input port.

* * * * *